US006847793B2

(12) United States Patent
Suzuki et al.

(10) Patent No.: US 6,847,793 B2
(45) Date of Patent: Jan. 25, 2005

(54) TEMPERATURE CONTROL FOR AN IMAGE HEATING APPARATUS

(75) Inventors: Masahiro Suzuki, Shizuoka (JP); Tomonori Shida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/330,102

(22) Filed: Dec. 30, 2002

(65) Prior Publication Data

US 2003/0147664 A1 Aug. 7, 2003

(30) Foreign Application Priority Data

Jan. 8, 2002 (JP) ..... 2002-001424
Dec. 19, 2002 (JP) ..... 2002-368256

(51) Int. Cl.[7] ..... G03G 15/20

(52) U.S. Cl. ..... 399/69; 219/216; 399/68; 399/328

(58) Field of Search ..... 399/67, 68, 69, 399/328; 219/216

(56) References Cited

U.S. PATENT DOCUMENTS 5,289,247 A * 2/1994 Takano et al. ..... 399/68
5,315,350 A * 5/1994 Hirobe et al. ..... 399/69
5,321,481 A * 6/1994 Mathers ..... 399/69
5,659,844 A 8/1997 Fujiwara ..... 399/69
6,087,641 A * 7/2000 Kinouchi et al. ..... 219/619
6,343,195 B1 * 1/2002 Abe et al. ..... 399/69
6,453,130 B1 * 9/2002 Richtsmeier ..... 399/69
6,567,624 B1 * 5/2003 Murata ..... 399/69
2002/0106211 A1 8/2002 Suzuki et al. ..... 399/69

FOREIGN PATENT DOCUMENTS

JP 10-268697 * 10/1998 ..... G03G/15/20

* cited by examiner

*Primary Examiner*—Fred Braun
(74) *Attorney, Agent, or Firm*—Fitzpatrick, Cella, Harper & Scinto

(57) ABSTRACT

An image forming apparatus is provided with a heating device, a conveying device, and a control device, wherein the control device has a mode for changing the set temperature from a first temperature to a second temperature higher than the first temperature when the leading edge of the recording material passes through the nip portion by a predetermined distance and the predetermined distance is equal to a value 0.3 to 2.0 times larger than the distance between the nip portion and the carrying device. Thereby, a recording-material jam is controlled and the image quality is prevented from deteriorating.

19 Claims, 10 Drawing Sheets

TEMPERATURE CONTROL FOR AN IMAGE HEATING APPARATUS

BACKGROUND OF THE INVENTION

1. Field of the Invention

The present invention relates to an image heating apparatus to be preferably used as a heating-fixing device of a copying machine or a printer using a recording system such as an electrophotographic system, electrostatic recording system, or magnetic recording system.

2. Related Background Art

In the case of an image heating apparatus such as a heat-fixing device mounted on a copying machine or printer, a separation claw contact-set to the surface of a fixing roller to forcibly separate a fixed recording material from the fixing roller is known as means for preventing a heated and fixed recording material from winding around the fixing roller. However, because the separation claw easily scratches the surface of the fixing roller because of its mechanism, there is a problem that scratches on the fixing roller due to the separation claw are transferred to an image when fixed to deteriorate the image quality. Moreover, in the case of a fixing apparatus using a flexible sleeve instead of the fixing roller, it is difficult to a separation claw for this use.

Therefore, a configuration is used in which a fixed recording material is curvature-separated from a fixing roller or fixing film by using the curvature of the fixing roller or fixing film.

However, the above fixing apparatus using no separation claw has the following problems.

A recording material is supported by one point of a fixing nip portion from the time when the leading edge of the recording material in its carrying direction passes through a fixing nip portion up to the time when it reaches a discharge roller. Therefore, under the above state, the carrying behavior of the above leading-edge region is unstable. Particularly, in the case of a recording material made of a thin paper having a weak kneed or an OHT and the like film which is extremely weak-kneed when heat is applied, the recording material easily winds around a fixing roller because of being influenced by the adhesion between toner and a fixing roller. Moreover, when the carrying (conveying) direction at the fixing nip portion of a fixing apparatus is almost vertical, the escape angle of the recording material from the fixing nip portion becomes vertical. Or, the image face of the recording material turns downward and thereby, the recording material easily winds around the fixing roller because the gravity is added.

When the edge of the recording material in its carrying direction is discharged toward the fixing roller contacting with a toner image on the recording material while slightly winding around the roller, excessive heat is added to the leading edge of the recording material in its carrying direction. Therefore, a problem occurs that the toner image is hot-offset the image quality is easily deteriorated. Moreover, a problem occurs that the recording material twins around the fixing roller and is easily jammed.

SUMMARY OF THE INVENTION

The present invention is made to solve the above problems and its object is to provide an image heating apparatus capable of preventing a recording material from jamming.

It is another object of the present invention to provide an image heating apparatus capable of preventing an image quality from deteriorating.

It is still another object of the present invention to provide an image heating apparatus comprising:

heating means having a nip portion for holding and conveying the recording material;

conveying means provided immediately after the nip portion in the recording-material moving direction;

control means for controlling an electric power supply to the heating means so that a temperature of the heating means is maintained at a set temperature; wherein the control means has a mode for changing the set temperature from a first temperature to a second temperature higher than the first temperature when the leading edge of the recording material passes through the nip portion by a predetermined distance and the predetermined distance is 0.3 to 2.0 times larger than the distance between the nip portion and the conveying means.

It is still another object of the present invention to provide an image heating apparatus comprising:

heating means having a nip portion for holding and conveying the recording material; and conveying means provided immediately after the heating means in the recording-material conveying direction; wherein the apparatus has a mode for the heating member to heat the range from the leading edge of the recording material up to a predetermined distance at a temperature lower than the subsequent heating temperature and the predetermined distance is 0.9 to 2.6 times larger than the distance between the nip portion and the conveying means.

It is still another object of the present invention to provide an image heating apparatus comprising:

heating means having a nip portion for holding and conveying the recording material;

conveying means provided immediately after the heating means in the recording-material moving direction; and control means for controlling an electric power supply to the heating means so that a temperature of the heating means is maintained at a set temperature; wherein the control means has a mode for changing the set temperature from a first temperature to a second temperature higher than the first temperature and set the mode in accordance with the type of the recording material.

It is still another object of the present invention to provide an image heating apparatus comprising:

heating means having a nip portion for holding and conveying the recording material, the heating means having a heating member and a backup member for forming the nip portion together with the heating material;

conveying means provided immediately after the nip portion in the recording-material moving direction; and control means for controlling an electric power supply to the heating means so that a temperature of the heating means is maintained at a set temperature; wherein the control means has a mode for changing the set temperature from a first temperature to a second temperature higher than the first temperature after the leading edge of the recording material passes through the nip portion and sets the first temperature in accordance with a temperature state of the backup member.

Still further objects of the present invention will become more apparent by reading the following detailed description while referring to the accompanying drawings.

DESCRIPTION OF THE PREFERRED EMBODIMENTS

Embodiments of the present invention are described below by referring to the accompanying drawings.

(First Embodiment)

First, first embodiment of the present invention is described below.

Figure 1:
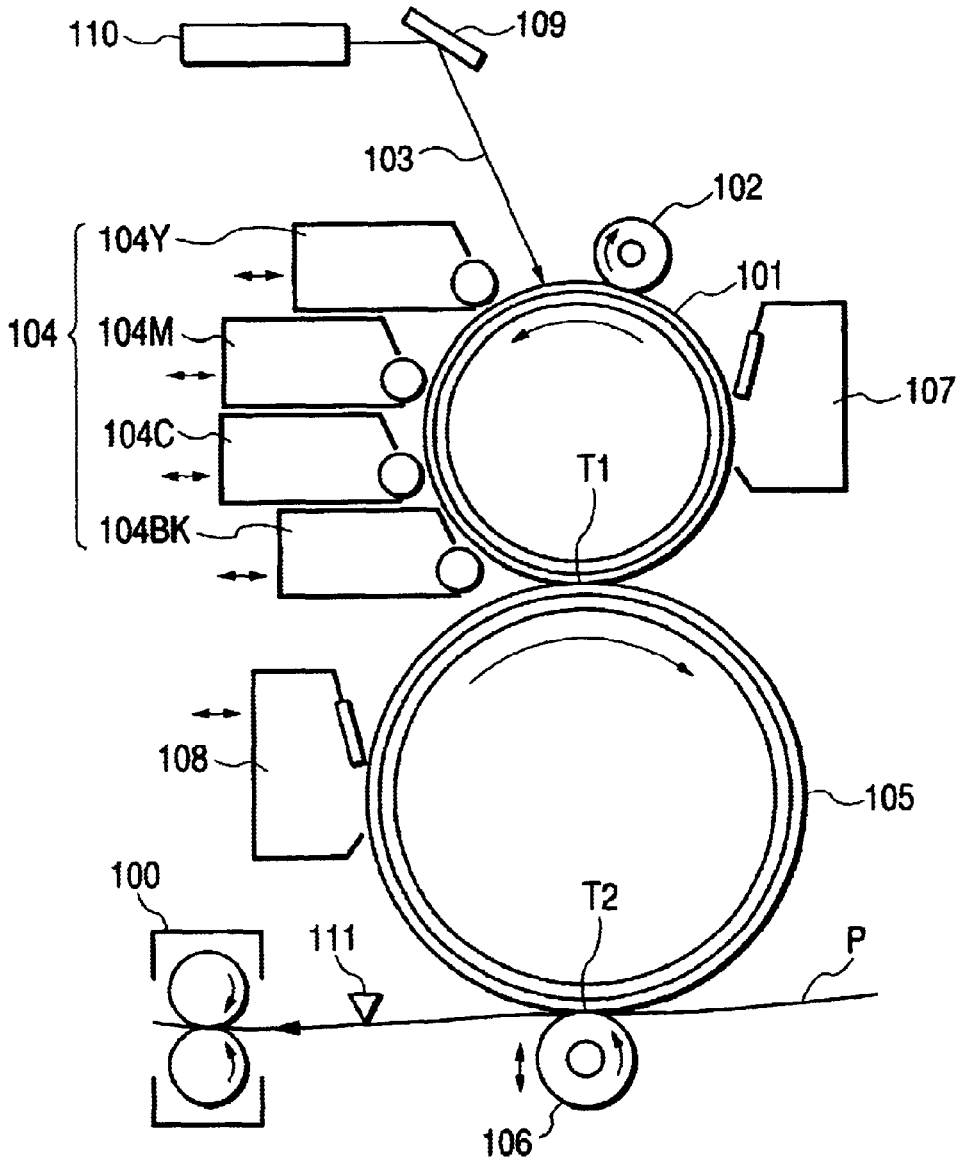
FIG. 1 is a schematic sectional view showing a schematic configuration of an image forming apparatus including an image heating apparatus of the present invention.

FIG. 1 is an illustration showing a schematic configuration of an image forming apparatus including an image heating apparatus of the present invention. The image forming apparatus of this embodiment is a color laser printer.

In the case of the image forming apparatus, a photosensitive drum 101 serving as a latent-image bearing member formed by an organic photoconductor or amorphous-silicon photoconductor rotates at a predetermined carrying (conveying) speed (circumferential speed) counterclockwise as shown by the arrow. Then, the photosensitive drum 101 is given a predetermined polarity and charged at a uniform potential by a charging apparatus 102 such as a charging roller while it is rotated.

Then, scan and exposure of purposed image information are applied to the charging face of the drum 101 by a laser beam 103 emitted from a laser-beam box (laser scanner) 110. The laser-beam box 110 outputs the laser beam 103 switched on or off and modulated correspondingly to a time-series electrical digital signal of the image information output from an image-signal generator (not illustrated) such as an image scanner and an electrostatic latent image corresponding to the purposed image information scanned and exposed on the surface of the photosensitive drum 101. In this case, the laser beam emitted from the laser optical box 110 is deflected at the exposure position of the photosensitive drum 101 by a mirror 109.

To form a full-color image, a first color-separation-component image in a purposed full-color image such as a yellow-component image is scanned and exposed and a latent image is formed and developed as a yellow toner image in accordance with the operation of a yellow developing device 104Y of a four-color developing apparatus 104. The yellow toner image is transferred to the surface of an intermediate transfer drum 105 at a primary transfer part T1 serving as a contact part (or proximity part) between the photosensitive drum 101 and the intermediate transfer drum 105. The surface of the photosensitive drum 101 after the toner image is transferred to the surface of the intermediate transfer drum 105 is cleaned by a cleaner 107 because attached residue such as transfer residual toner is removed.

The above process cycle consisting of charging scanning, exposure, development, primary transfer, and cleaning is successively executed for color-separation-component images such as a second color-separation-component image (such as a magenta component image; a magenta developing device 104M operates), a third color-separation-component image (such as a cyan-component image; a cyan developing device 104C operates), and a fourth color-separation-component image (such as a black component image; a black developing device 104B operates), and four toner images of an yellow toner image, magenta toner image, cyan toner image, and black toner image of a purposed full-color image are successively superimposed on and transferred to the surface of the intermediate transfer drum 105 and color toner images corresponding to the purposed full-color image are synthesized and formed.

The intermediate transfer drum 105 is constituted by forming a middle-resistance elastic layer and a high-resistance surface layer on a metallic drum, which is rotated clockwise as shown by the arrow at the same circumferential speed as the photosensitive drum 101 while contacting with or being adjacent to the photosensitive drum 101 to supply a bias potential to the metallic drum of the intermediate drum 105 and transfer the toner image at the side of the photosensitive drum 101 to the side face of the intermediate transfer drum 105 in accordance with a potential difference from the photosensitive drum 101.

The color toner image formed on the surface of the above intermediate transfer drum 105 is transferred to the surface of a recording material P supplied from a sheet-feed part (not illustrated) to a secondary transfer part T2 serving as the contact nip portion between the intermediate transfer drum 105 and the transfer roller 106 at a predetermined timing at the secondary transfer part T2. The transfer roller 106 simultaneously transfers synthesized color toner images from the surface of the intermediate transfer drum 105 to the recording material P by supplying electric charges having a polarity opposite to that of toner from the back of the recording material P.

The recording material P passing through the secondary transfer part T2 is separated from the surface of the intermediate transfer drum 105 and introduced into a fixing apparatus 100 serving as fixing means, and an unfixed toner image is heated and fixed to become a fixed toner image and the fixed toner image is discharged an external discharge tray (not illustrated).

The intermediate transfer drum 105 after transferring the color toner image to the recording material P is cleaned because attached residues such as transfer residual toner and paper powder are removed by a cleaner 108. The cleaner 108 is held while always contacting with the intermediate transfer drum 105 and normally held under a non-contact state with the intermediate transfer drum 105 but held under a contact state with the intermediate transfer drum 105 when secondary transfer of a color toner image from the intermediate transfer drum 105 to the recording material P is executed.

Moreover, the transfer roller 106 is always held by the intermediate transfer drum 105 under a non-contact state but held under a contact state through the recording material P when secondary transfer of a color toner image from the intermediate transfer drum 105 to the recording material P is executed.

Then, the fixing apparatus (image heating apparatus or heating means) 100 provided for the above image forming apparatus is described below by referring to FIGS. 2 to 5.

Figure 2:
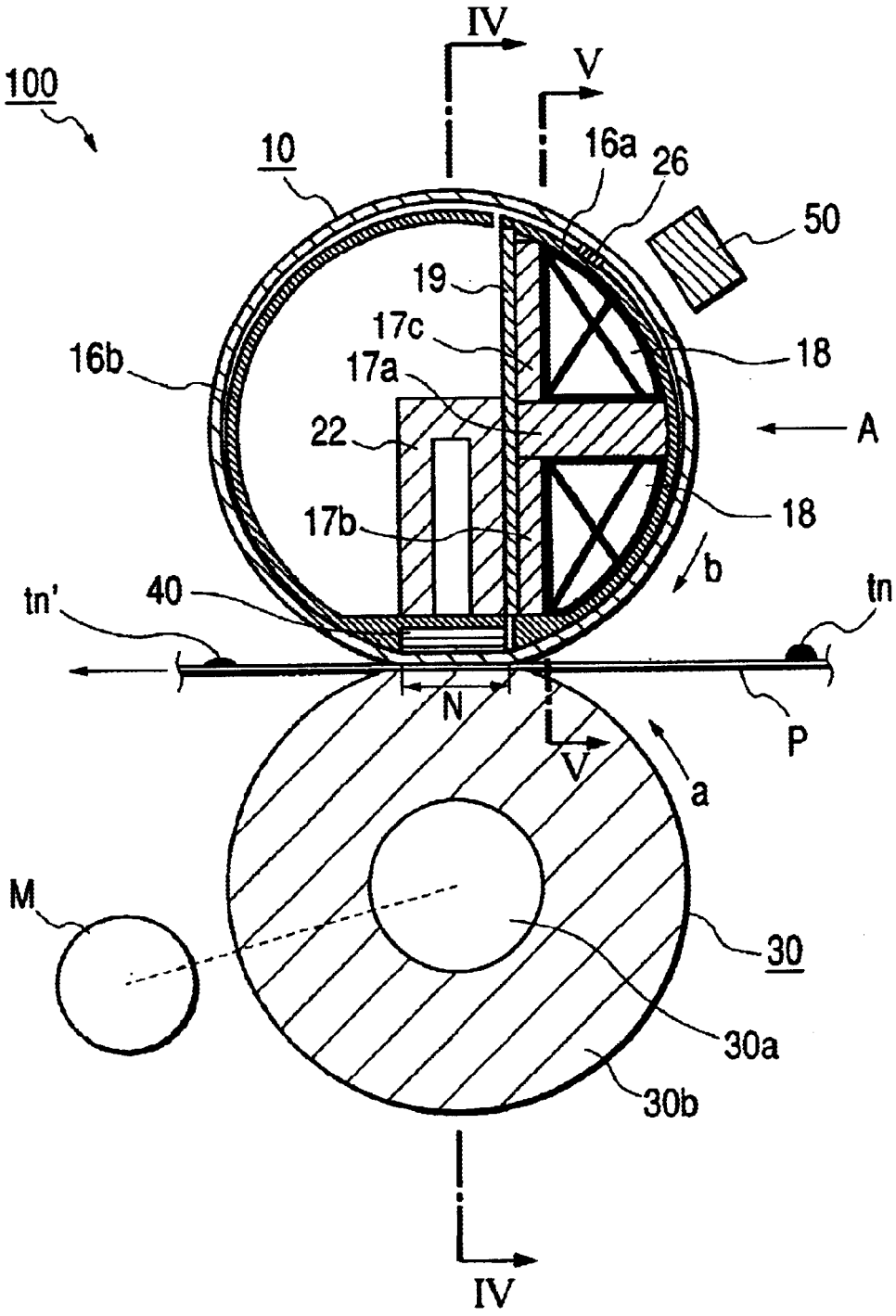
FIG. 2 is a schematic sectional view of a magnetic-induction-heating fixing apparatus serving as an image heating apparatus of the present invention.
Figure 3:
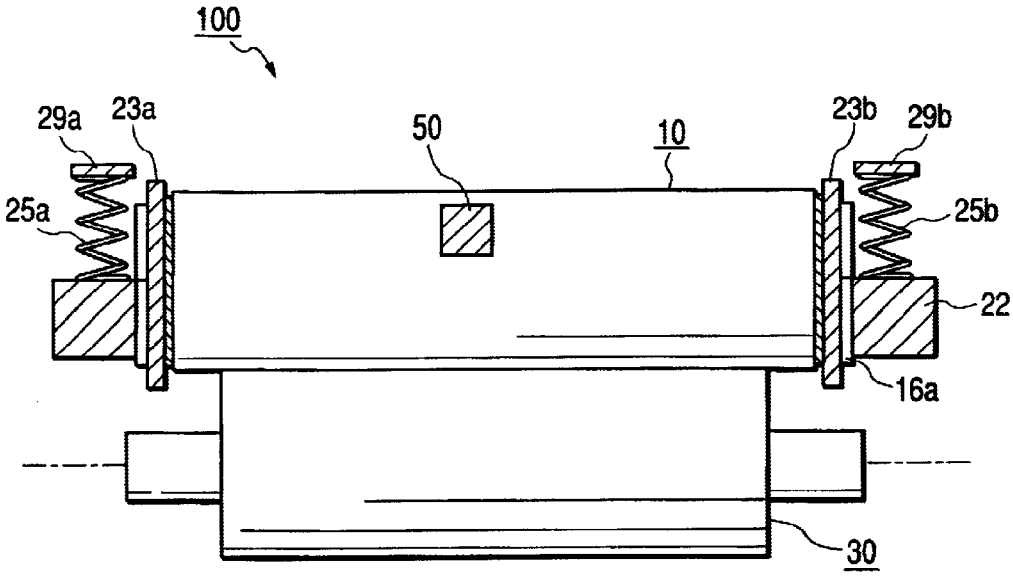
FIG. 3 is a schematic view seen from the. direction A of the fixing apparatus in FIG. 2.
Figure 4:
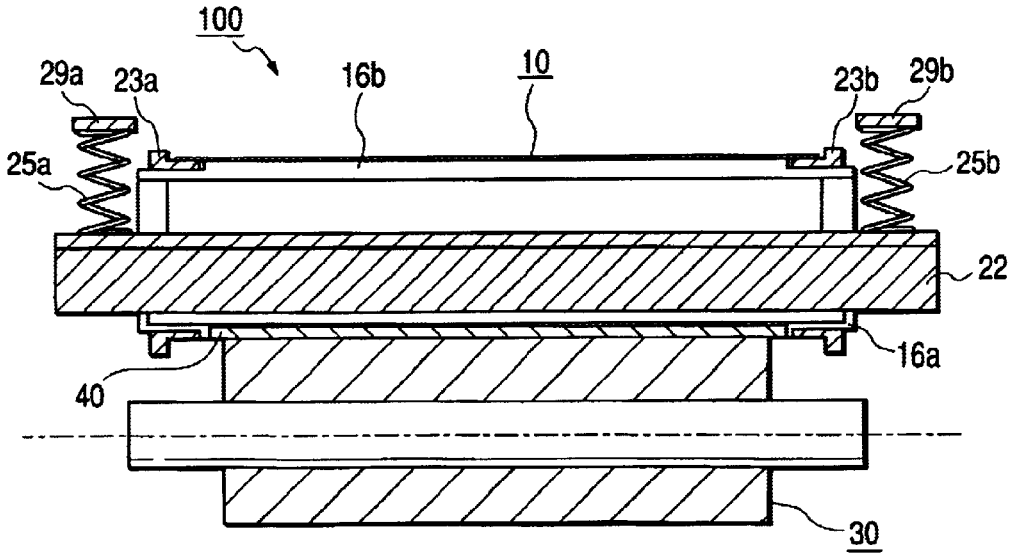
FIG. 4 is a sectional view taken along the line IV—IV of the fixing apparatus in FIG. 2.
Figure 5:
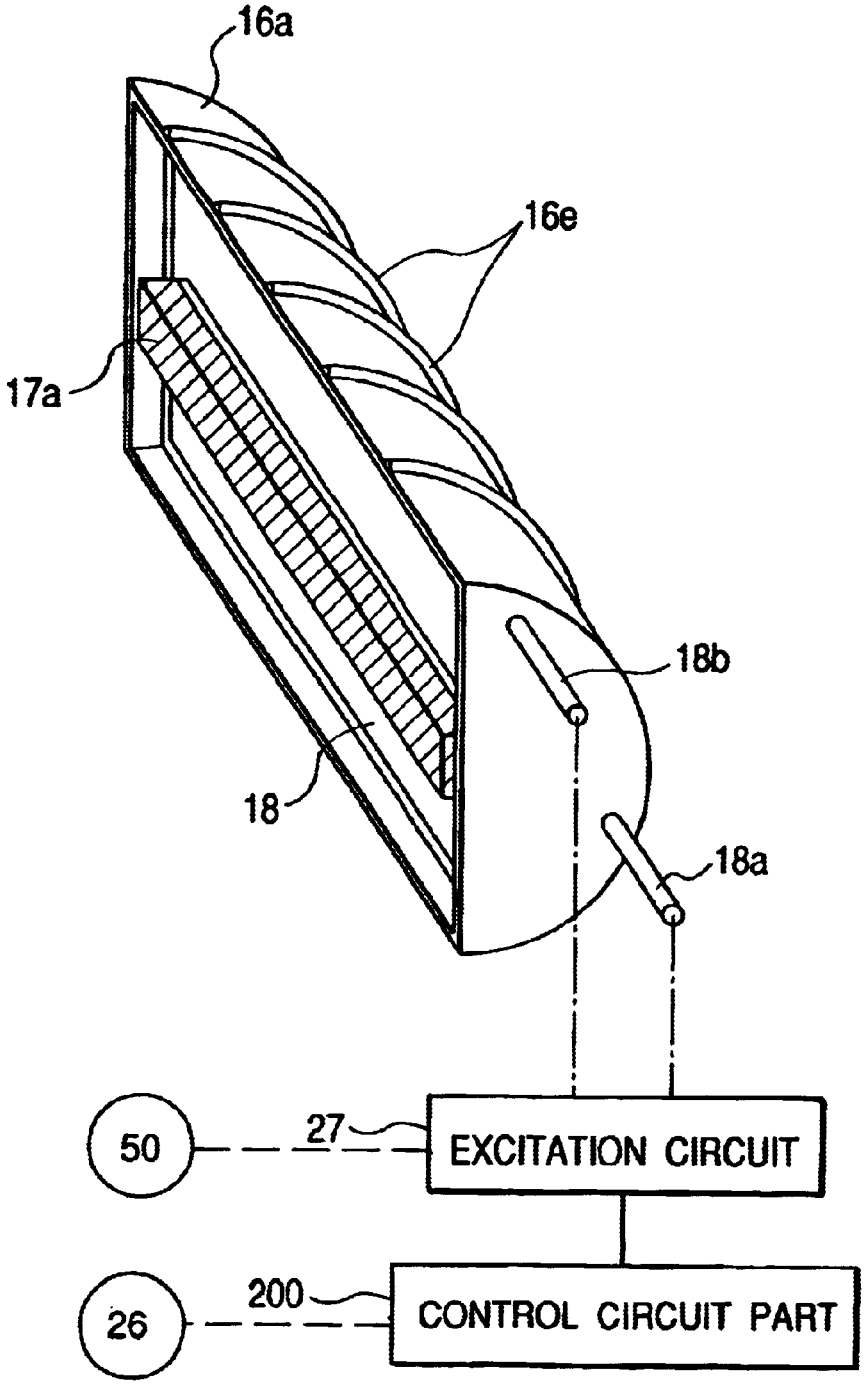
FIG. 5 is a sectional view taken along the line V—V of the magnetic-field generating means provided for the fixing apparatus in FIG. 2.

The fixing apparatus 100 of the embodiment uses a magnetic-induction-type film heating system. FIGS. 2 to 5 are illustrations showing a configuration of an essential part of the fixing apparatus 100, in which FIG. 2 is a sectional schematic view of the side face, FIG. 3 is a front schematic view viewed from the direction A in FIG. 2, FIG. 4 is a sectional schematic view taken along the line IV—IV in FIG. 2, and FIG. 5 is a perspective schematic view (fixing film is not illustrated) showing the cross section taken along the line V—V in FIG. 2. In the case of this embodiment, a fixing film corresponds to a heating member and a pressure roller corresponds to a backup member.

In FIG. 2, film guides 16*a* and 16*b* respectively have a tub-like shape whose cross section is an approximately semicircular arc to form a rough cylinder by facing opening sides each other. A fixing film 10 which is a cylindrical film is externally loosely fitted to the outer periphery of each of the film guides 16*a* and 16*b*.

Magnetic cores 17*a*, 17*b*, and 17*c*, an excitation coil 18, and an excitation circuit 27 (refer to FIG. 7) constitutes a magnetic-field generating means and the fixing film 10 self-produces heat by a magnetic field generated by the excitation coil 18. The magnetic cores 17*a*, 17*b*, and 17*c* are arranged like T-shape inside of the film guide 16*a*. The excitation coil 18 is held in a space surrounded by the magnetic cores 17*a* and 17*c* and the film guide 16*a* and a space surrounded by the magnetic cores 17*a* and 17*b* and the film guide 16*a*.

It is preferable to use a material which is a member having a high magnetic permeability and is used for the core of a transformer such as ferrite or permalloy for the magnetic cores 17*a*, 17*b*, and 17*c* and it is more preferable to use ferrite having a small magnetic loss even at 100 kHz or higher for them.

As shown in FIG. 5, the excitation coil 18 has power supply parts 18*a* and 18*b* and is connected to the excitation circuit 27 by the power supply parts 18*a* and 18*b*. The excitation circuit 27 can generate high frequencies of 20 to 500 kHz by a switching power source. The excitation coil 18 generates an alternate magnetic flux by an alternate current (high-frequency current) supplied from the excitation circuit 27.

The temperature of the fixing film 10 is controlled so as to be maintained at a predetermined temperature because current supply to the excitation coil 18 is controlled by a temperature control system (control circuit 200) including a temperature sensor 26. The temperature sensor 26 is a temperature detecting device such as a thermistor. That is, the fixing-film-detection-temperature information by the temperature sensor 26 is input to the control circuit part 200 and the control circuit part 200 controls the power to be supplied from the excitation circuit 27 to the excitation coil 18 so that temperature information input from the temperature sensor 26 maintains a predetermined fixing temperature. The control circuit 200 has functions for changing set temperatures and fixing modes.

The film guides 16*a* and 16*b* respectively have functions for pressurizing a fixing-nip portion N, supporting the excitation coil 18 and the excitation core 17 serving as magnetic-field generating means, supporting the fixing film 10, and stabilizing carrying of the fixing film 10 under rotation. The film guides 16*a* and 16*b* respectively use a material having an insulating characteristic not preventing a magnetic flux from passing and capable of withstanding a high load. As the above material, any one of the following materials can be used: polyimide resin, polyamide resin, polyamide-imide resin, polyether-ketone resin, polyether-sulphone resin, polyphenylene-sulfide resin, and liquid-crystal polymer.

In a film guide 16*b*, a sliding member 40 longitudinal in the vertical direction to the paper surface is set to the inside of the fixing film 10 at the opposite face to the pressure roller 30 of the fixing nip portion N as shown in FIG. 2. That is, the sliding member 40 is set to the position opposite to the pressure roller 30 through the fixing film 10 at the fixing nip portion N. The sliding member 40 is a member for supporting the fixing film 10 from its inner-peripheral face against the pressure of the pressure roller 30 at the fixing nip portion N.

It is preferable to use a very-slippery member for the sliding member 40 in order to reduce the sliding resistance. As the above member, any one of the following can be used: fluororesin, glass, boron nitride, and graphite, etc. It is more preferable that the sliding member 40 is a member having a high heat conductivity in addition to the slippery characteristic. This type of the sliding member 40 has an effect of uniforming a temperature distribution in the longitudinal direction. For example, when passing a small-size sheet, the heat quantity of the non-sheet passing part of the fixing film 10 is transferred to the sliding member 40 and the heat quantity of the non-sheet passing part is transferred to the small-size-sheet passing part due to the heat conduction in the longitudinal direction of the sliding member 40. Thereby, an effect of reducing the power consumption when passing a small-size sheet is also obtained. A composite material such as a metal such as mirror-polished aluminum or a metal in which fluororesin particles, boron-nitride particles, or graphite particles are dispersed can be used for the sliding member 40. Moreover, it is possible to use a two-layer member obtained by coating a high-heat-conductivity member with a slipper member such as a member obtained by coating aluminum nitride with glass. This embodiment uses a member obtained by coating an alumina substrate with glass.

When the sliding member 40 has a conductivity, it is preferable to set the sliding member 40 outside of a magnetic field generated by the excitation coil 18 and magnetic cores 17*a*, 17*b*, and 17*c* which serve as magnetic-field generating means so that the sliding member 40 is not influenced by the magnetic fields generated by them. Specifically, the sliding member 40 is set to a position separate from the magnetic core 17*b* to the excitation coil 18 outside of the magnetic path due to the excitation coil 18.

To further decrease the sliding frictional force between the sliding member 40 and the fixing film 10 at the fixing nip portion N, it is also possible to supply a lubricant such as heat-resistant grease between the sliding member 40 and the fixing film 10. By applying the lubricant, it is possible to further reduce the sliding resistance and increase the service life of the apparatus.

A horizontally-long pressurizing stiff stay 22 having a U-shaped cross section is brought into contact with the inside flat part of the film guide 16*b*. Moreover, an insulating member 19 for insulating the pressurizing stiff stay 22 from each magnetic core 17 is set between the pressurizing stiff stay 22 and each magnetic core 17.

Moreover, flange members 23*a* and 23*b* (refer to FIG. 3) are externally fitted to the right and left edges of the assembly of the film guides 16*a* and 16*b* and rotatably set while fixing the above-right and left parts. The flange parts 23 receive edges of the fixing film 10 when rotated and control deviated movement of each of the film guides 16 in their longitudinal direction.

The pressure roller 30 serving as a backup member is constituted by 30*a* and a heat-resistant elastic-material layer 30*b* which is coaxially integrally formed around the core like a roller and made of silicone rubber, fluororubber, or fluororesin and the like. The pressure roller 30 is held because the both edges of the core 30*a* are rotatably bearing-held between chassis-side sheet metals (not illustrated) of the fixing apparatus.

In FIG. 3, by setting pressure springs 25*a* and 25*b* between the both edges of the pressurizing stiff stay 22 and spring holding members 29*a* and 29*b* at the apparatus chassis (not illustrated) side respectively, a raising force is applied to the pressurizing stiff stay 22. Thereby, the lower face of the sliding member 40 provided for the film guide 16*b* and the upper face of the pressure roller 30 are pressure-welded each other at the both sides of the fixing film 10 and the fixing nip portion N having a predetermined width is formed.

The pressure roller 30 is rotated counterclockwise as shown by the arrow a in FIG. 2 by the driving means M. By rotating the pressure roller 30, a friction force is generated between the pressure roller 30 and the outside face of the fixing film 10 and a rotational force works on the fixing film 10. Then, fixing film 10 rotates around the outsides of the film guides 16*a* and 16*b* clockwise as shown by the arrow b in FIG. 2 at a circumferential speed almost corresponding to the circumferential speed of the pressure roller 30 while bringing the inner periphery of the fixing film 10 into close contact with and sliding on the lower face of the sliding member 40. That is, the fixing film 10 is rotated while following the pressure roller 30 in accordance with the surface friction force with the pressure roller.

As shown in FIG. 5, a plurality of convex rib parts 16*e* are formed on the periphery of the film guide 16*a* at predetermined intervals in its longitudinal direction. Thereby, the contact sliding resistance between the periphery of the film guide 16*a* and the inside face of the fixing film 10 is reduced to decrease the rotational load of the fixing film 10. It is also possible to form the above convex rib parts on the film guide 16*b*.

Figure 6:
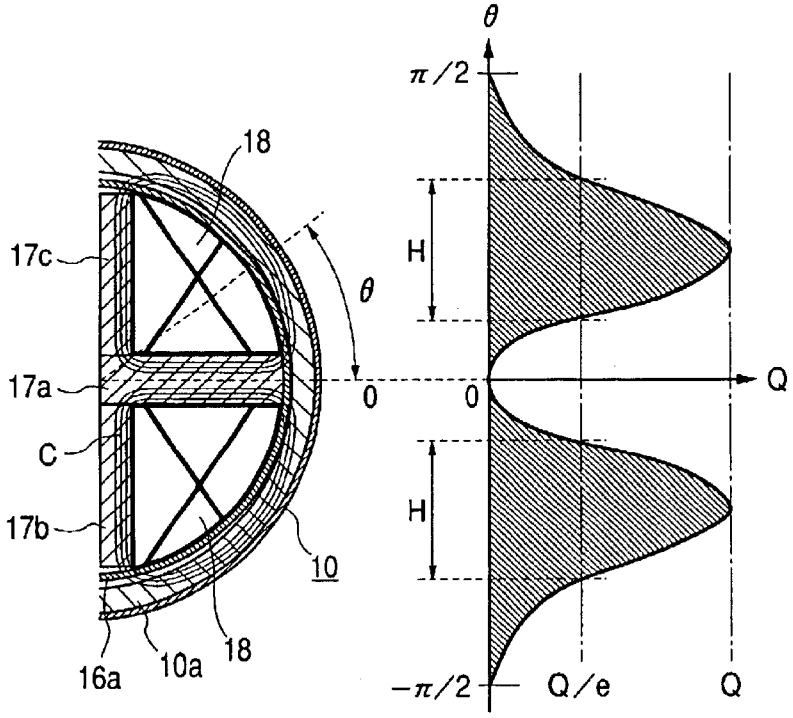
FIG. 6 is an illustration showing the relation between magnetic-field generating means provided for the fixing apparatus in FIG. 2 and heat quantity Q in the circumferential direction of a fixing sleeve in the magnetic field generated by the magnetic-field generating means.

FIG. 6 schematically shows a state of an alternate magnetic field generated by magnetic-field generating means.

A magnetic flux C shows a part of a generated alternate magnetic flux. The alternate magnetic field guided by the magnetic cores 17*a*, 17*b*, and 17*c* generates an eddy current on an exothermic layer 10*a* of the fixing film 10 between the magnetic cores 17*a* and 17*b* and between the magnetic cores 17*a* and 17*c*. The eddy current generates Joule heat (eddy current loss) in the exothermic layer 10*a* in accordance with the specific resistance of the exothermic layer 10*a*.

A calorific value Q is decided in accordance with the density of the magnetic flux C passing through the exothermic layer 10*a*, which shows the distribution of the graph in FIG. 6. In the graph shown in FIG. 6, the axis of ordinate shows the circumferential-directional position of the fixing film 10 shown by an angle θ when assuming the center of the magnetic core 17*a* as 0 and the axis of abscissa shows the calorific value Q of the fixing film 10 in the exothermic layer 10*a*. In this case, an exothermic region H is defined as a region having a calorific value of Q/e or more when assuming the maximum calorific value as Q (e represents the base of natural logarithm). This is a region from which a calorific value necessary for a fixing process is obtained.

As described above, because power is supplied from the excitation circuit 27 to the excitation coil 18, the fixing film 10 generates heat in accordance with electromagnetic induction and rises up to a preset temperature. Then, while the fixing film 10 is controlled to the preset temperature, the recording material P on which an unfixed toner tn image carried (conveyed) from image forming means is formed is introduced between the fixing film 10 and the pressure roller 30 so that the image face is opposite to the fixing-film face. Then, while the recording material P is held and carried (conveyed) together with the fixing film 10 at the fixing nip portion N, the unfixed toner tn on the recording material P is heated and fixed. The unfixed toner tn passes through the fixing nip portion N and then, it is cooled to serve as fixed toner tn'.

In the case of this embodiment, because toner containing a low softening substance is used for the toner tn, the fixing apparatus 100 is not provided with an oil coating mechanism for preventing offset. When using toner containing no low softening substance, it is allowed to provide an oil coating mechanism for the fixing apparatus 100. Also when using toner containing a low softening substance, it is allowed to perform oil coating or cooling separation.

A thermoswitch 50 serving as a temperature detecting device for cutting off the supply of power to the excitation coil 18 under thermal runaway of a fixing apparatus is set to an opposite position to the exothermic region H (FIG. 6) on the outside face of the fixing film 10 in a non-contact state. The distance between the thermoswitch 50 and the fixing film 10 is set to approx. 2 mm. Thereby, the fixing film 10 is not scratched due to contact with the thermoswitch 50 and thus, it is possible to prevent an image from being deteriorated due to permanent use.

Figure 7:
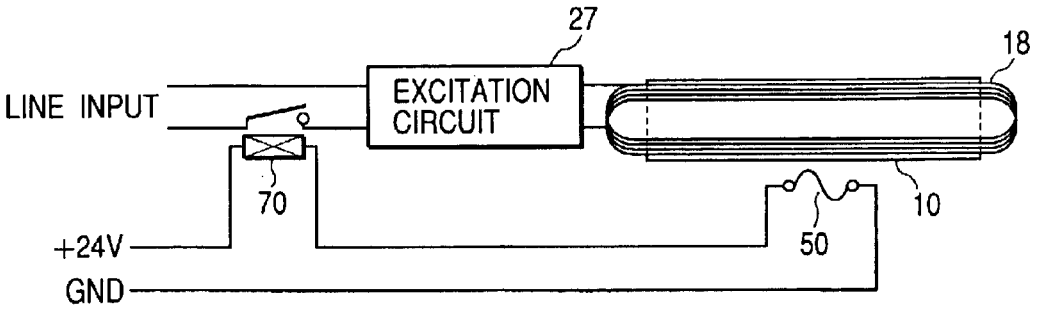
FIG. 7 is an illustration showing the relation between magnetic-field generating means provided for the fixing apparatus in FIG. 2 and an excitation circuit for driving the magnetic-field generating means.

FIG. 7 is a circuit diagram of a thermal-runaway preventing circuit used for this embodiment. The thermoswitch 50 is built in the thermal-runaway preventing circuit. The thermoswitch 50 is connected with a power source of 24 VDC and a relay switch 70 in series. When the thermoswitch 50 is turned off, supply of power to the relay switch 70 is cut off, the relay switch 70 operates, supply of power to the excitation circuit 27 is cut off, and thereby supply of power to the excitation coil 18 is cut off.

According to this embodiment, even when the fixing apparatus 100 stops while the recording material P is held caught by the fixing nip portion N under thermal runaway of the fixing apparatus 100, supply is continuously supplied to the excitation coil 18, and the fixing film 10 keeps generating heat, no heat is generated in the fixing nip portion N by which the recording material P is caught differently from a configuration in which heat is generated at the fixing nip portion N. Therefore, the recording material P is not directly heated. Moreover, because the thermoswitch 50 is set to the exothermic region H having a large calorific value, supply of power to the excitation coil 18 is cut off by the relay switch 70 when the thermoswitch 50 detects an abnormal temperature rise and opens. According to this embodiment, because the ignition temperature of paper is almost equal to approx. 400° C., the paper does not ignite and thus, it is possible to stop heat generation of the fixing film 10. It is also allowed to use a temperature fuse in stead of a thermoswitch.

The excitation coil 18 constituting magnetic-field generating means is formed by using a bundle wire in which a plurality of thin copper wires each of which is insulation-coated are bundled and coiling the bundle wire up to several turns.

It is preferable to use a heat-resistant coating material for a coating member to be insulation-coated by considering heat conduction due to heat generation of the fixing film 10. For example, it is preferable to use a coating made of amide-imide or polyimide. It is also allowed to improve the congestion degree of the excitation coil 18 by applying a pressure to the excitation coil 18 from the outside.

As shown in FIG. 2, the shape of the excitation coil 18 is formed so as to follow the curved face of the fixing film 10. Moreover, the distance between the exothermic layer of the fixing film 10 and the excitation coil 18 is set to approx. 2 mm.

It is preferable to use a material superior in insulation property and having a high heat resistance for the material of the insulating member 19. For example, it is preferable to select any one of phenol resin, fluororesin, polyimide resin, polyamide resin, polyamide-imide resin, polyether-ketone resin, polyether-sulphone resin, polyphenylene-sulfide resin, PFA resin, PTFE resin, FEP resin, and LCP resin.

A magnetic-flux absorbing efficiency is further improved by decreasing distances between the magnetic cores 17*a*, 17*b*, and 17*c*, the excitation coil 18, and the exothermic layer of the fixing film 10. It is preferable that the distance is 5 mm or less because a fixing film can efficiently absorb a magnetic flux. A distance exceeding the above range is not preferable because the magnetic-flux absorbing efficiency is extremely deteriorated. When the distance between the exothermic layer of the fixing film 10 and the excitation coil 18 is 5 mm or less, it is not necessary to keep the distance constant.

In FIG. 5, in the case of 18*a* and 18*b* extended from the excitation coil 18, insulation coating is applied to the outside of the bundle wire.

Figure 8:
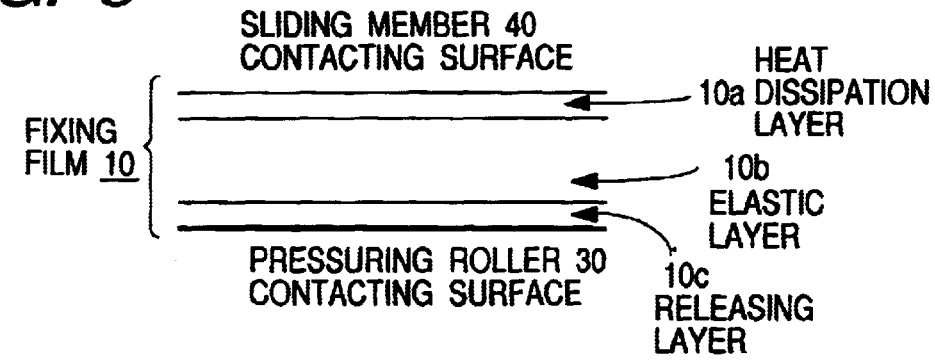
FIG. 8 is a local sectional view showing a layer configuration of a fixing sleeve provided for the fixing apparatus in FIG. 2.

FIG. 8 is a schematic diagram showing the layer configuration of the fixing film 10 serving as an anchoring body of this embodiment.

The fixing film 10 of this embodiment has a composite structure of an exothermic layer 10*a* made of such as an electromagnetic-induction exothermic metallic film, an elastic layer 10*b* formed on the outside face of the exothermic layer 10*a*, and a mold release layer 10*c* formed on the outside face of the elastic layer 10*b*. It is allowed to form a primer layer (not illustrated) between layers in order to bond the exothermic layer 10*a* with the elastic layer 10*b* and the elastic layer 10*b* with the mold release layer 10*c*. In the case of the approximately-cylindrical fixing film 10 in FIG. 8, the exothermic layer 10*a* is present in the inside where the exothermic layer 10*a* contacts with the sliding member 40 and the mold release layer 10*c* is present in the outside where the mold release layer 10*c* contacts with a pressure roller or a recording material (material to be heated).

As described above, because an alternate magnetic field works on the exothermic layer 10*a*, an eddy current is generated in the exothermic layer 10*a* and the exothermic layer 10*a* generates heat. The heat is transferred to the elastic layer 10*b* and mold release layer 10*c*, the whole fixing film is heated to heat the recording material P to be passed through the fixing nip portion N, and a toner image is heated and fixed.

Though it is possible to use a magnetic or non-magnetic metal for the exothermic layer 10*a*, a magnetic metal is preferably used. As the magnetic metal, one of the following metals is preferably used: nickel, iron, ferromagnetic stainless steel, nickel-cobalt alloy, and permalloy. Moreover, to prevent a metal fatigue due to a repetitive bending stress received when the fixing film 10 rotates, it is preferable to use a member in which manganese is added to nickel.

It is preferable to set the thickness of the exothermic layer 10*a* to a value larger than the cuticle depth σm shown by the following expression (1) and 200 μm or less. By setting the thickness of the exothermic layer 10*a* in the above range, the exothermic layer 10*a* can efficiently absorb electromagnetic waves and therefore, it is possible to make the exothermic layer 10*a* efficiently generate heat.

$$\sigma=503\times(\rho/f\mu)^{1/2} \quad (1)$$

In the above expression, f denotes the frequency Hz of an excitation circuit, μ represents the permeability of the exothermic layer 10*a*, ρ represents the resistivity Ωm of the exothermic layer 10*a*.

Figure 10:
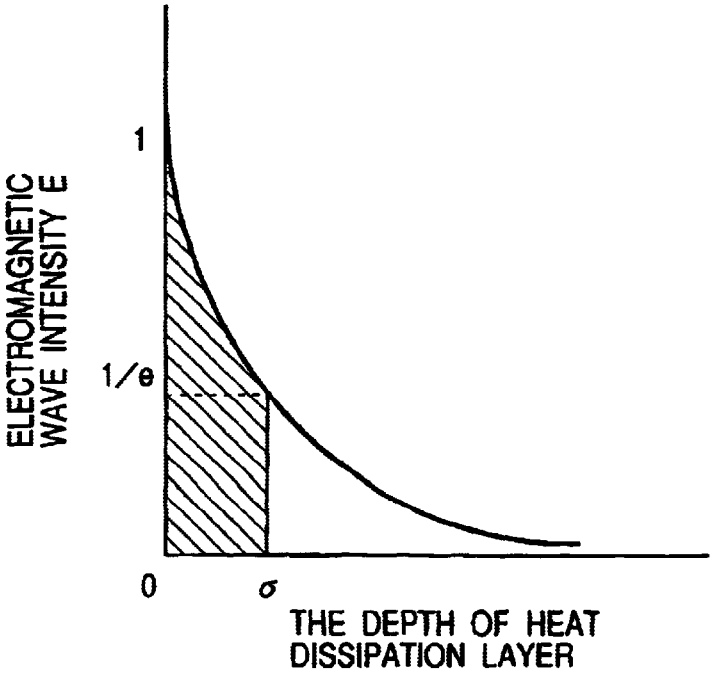
FIG. 10 is a graph showing the relation between the depth of an exothermic layer of a fixing sleeve and the intensity of an electromagnetic wave generated by magnetic-field generating means.

The cuticle depth σ shows the depth of absorption of an electromagnetic wave used for electromagnetic induction. At a position deeper than the cuticle depth σ, the intensity is 1/e or less. Inversely saying, almost energies are absorbed before the cuticle depth σ (refer to the relation between exothermic-layer depth and electromagnetic-wave intensity shown in FIG. 10).

It is more preferable to set the thickness of the exothermic layer 10*a* in a range of 1 to 100 μm. When the thickness of the exothermic layer 10*a* is smaller than values in the above range, most electromagnetic energies are not absorbed and thereby, the efficiency is deteriorated. However, when the thickness of the exothermic layer 10*a* is larger than values in the above range, the stiffness of the exothermic layer 10*a* becomes excessively high, the flexibility is deteriorated, and thus it is not realistic to use the exothermic layer 10*a* as a rotator.

A material superior in heat resistance and heat conductivity such as silicon rubber, fluororubber, or fluorosilicon rubber is preferably used for the elastic layer 10*b*.

It is preferable that the thickness of the elastic layer 10*b* ranges between 10 and 500 μm in order to assure the fixed-image quality. When printing a color image, a set-solid image is formed over a large area on the recording material P particularly in the case of a photographic image. In this case, when a heating face (mold release layer 10*c*) cannot follow the irregularity of the recording material P or irregularity of the unfixed toner tn, heating irregularity occurs and gloss irregularity occurs in parts having a large heat-transfer quantity and a small heat-transfer quantity of an image. That is, the part having a large heat-transfer quantity has a high glossiness and the part having a small heat-transfer quantity has a low glossiness. When the thickness of the elastic layer 10*b* is smaller than values in the above range, the mold release layer 10*c* cannot follow the irregularity of the recording material P or unfixed toner tn and image gloss irregularity occurs. However, when the thickness of the elastic layer 10*b* is excessively larger than values in the above range, the heat resistance of the elastic layer excessively increases and it is difficult to realize quick start. It is preferable that the thickness of the elastic layer 10*b* ranges between 50 and 500 μm.

When the elastic layer 10*b* has an excessively-high hardness, it cannot follow the irregularity of the recording material P or unfixed toner tn and thereby, image gloss irregularity occurs. Therefore, it is preferable that the elastic layer 10*b* has a hardness of 60° (JIS-A) or less and it is more preferable that the elastic layer 10*b* has a hardness of 45° (JIS-A) or less.

It is preferable that the heat conductivity λ of the elastic layer 10*b* ranges between $2.5\times10^{-1}$ to $8.4\times10^{-1}$ W/m·° C. When the heat conductivity λ is smaller than values in the above range, the heat resistance is too large and a temperature rise on the surface layer *(mold release layer 10*c*) of the fixing film 10 becomes late. When the heat conductivity λ is larger than values in the above range, the hardness of the elastic layer 10*b* becomes excessively high or a compressive permanent strain easily occurs. It is more preferable to set the heat conductivity λ to $3.3\times10^{-1}$ to $6.3\times10^{-1}$ W/m·° C.

It is preferable to use a material having a high mold-release characteristic and a high heat resistance such as fluorosilicon resin, silicone resin, fluorosilicon rubber, fluororubber, silicone rubber, PFA, PTFE, or FEP for the mold release layer 10*c*.

It is preferable that the thickness of the mold release layer 10*c* ranges between 1 and 100 μm. When the thickness of the mold release layer 10*c* is smaller than values in the above range, a problem occurs that coating irregularity of a coating film occurs, a part having a low mold-release characteristic, or durability becomes insufficient. When the thickness of the mold release layer is larger than values in the above range, heat conductivity is deteriorated. Particularly, when using a resin material for the mold release layer 10*c*, the hardness of the mold release layer 10*c* becomes excessively high and the effect of the elastic layer 10*b* disappears.

Figure 9:
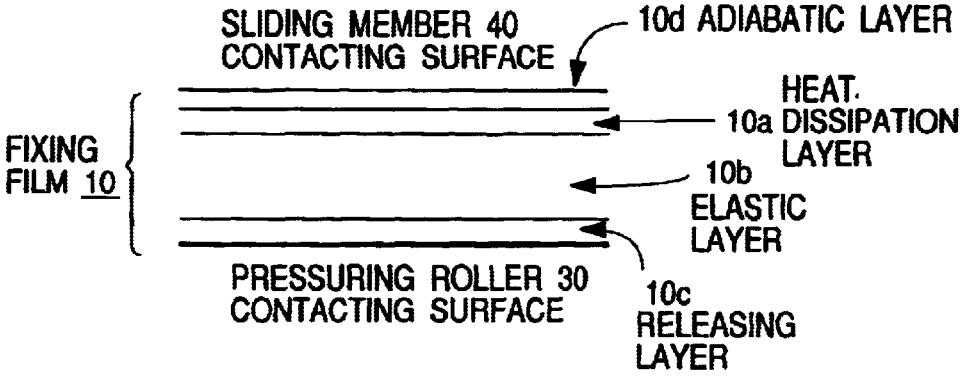
FIG. 9 is a local sectional view showing )another layer configuration of the fixing sleeve provided for the fixing apparatus in FIG. 2.

As shown in FIG. 9, in the configuration of the fixing film 10, it is allowed to form an adiabatic layer 10*d* on the contact face with the sliding member 40 of the exothermic layer 10*a*. As the adiabatic layer 10*d*, it is preferable to use a heat resistant resin such as fluororesin, polyimide resin, polyamide resin, polyamide-imide resin, PEEK resin, PES resin, PPS resin, PFA resin, PTFE resin, or FEP resin. Moreover, it is preferable that the thickness of the adiabatic layer 10*d* ranges between 10 and 1,000 μm. When the thickness of the adiabatic layer 10*d* is smaller than 10 μm, the adiabatic effect cannot be obtained and the durability is deteriorated. However, when the thickness of the adiabatic layer 10*d* exceeds 1,000 μm, distances from the magnetic cores 17*a*, 17*b*, and 17*c* up to the exothermic layer 10*a* increase and magnetic fluxes are not sufficiently absorbed by the exothermic layer 10*a*. Because the adiabatic layer 10*d* can insulate heat so that the heat generated in the exothermic layer 10*a* does not go to the inside of the fixing film 10, the heat supply efficiency to the recording material P is improved compared to the case of omitting the adiabatic layer 10*d*. Therefore, it is possible to control power consumption.

Moreover, by forming the adiabatic layer 10*d* by a slippery material, it is possible to reduce the sliding resistance between the sliding member 40 and the fixing film 10.

Then, temperature control of the fixing apparatus 100 which is a feature of the present invention is described below.

In the case of this embodiment, passing of the leading edge of a recording material in its carrying direction is detected by a registration detecting sensor (registration shutter) 111 serving as recoding-material detecting means provided for a predetermined position of the carrying path of the recording material. Then, the change timing of a set temperature when a recording material is fixed is calculated and decided by the control circuit 200 by considering the distance between the detection position of the registration sensor 111 and the fixing nip part N, the distance between the detection position of the registration sensor 111 and a discharge roller, and the carrying rate of the recording material between them.

It is allowed that the setting position of a registration detecting sensor while a recording material is carried, that is, the detection position of recording-material detecting means may be located at a discharge roller part or a position at the downstream side of the discharge roller part in the carrying direction of the recording material and it is also possible use the point of time when the recording-material detecting means detects the leading edge of the recording direction of the recording material as the set-temperature change timing. In this case, it is not necessary to calculate the set-temperature change timing by considering the distance between the detection position of the recording-material detecting means and the fixing nip part N and the distance between the detection position of the recording-material detecting means and the discharge roller while the carrying rate of the recording material between them is fixed and operated. However, it is necessary to set the detection position of the recording-material detecting means by previously considering them so that the set-temperature change timing becomes a desired timing.

In the case of the present invention, because set temperatures at a specified part of a recording material are locally changed under fixing, a fixing apparatus capable of linearly responding to the change of temperature-control temperatures is indispensable. In the case of the fixing apparatus of the image forming apparatus of this embodiment, the response of temperature control of the fixing apparatus is improved by using a fixing film having a comparatively-small heat capacity. A fixing sleeve is not restricted to a fixing film but it is possible to use any member as long as the member can quickly follow a change of set temperatures. Moreover, this embodiment further improves the temperature response of a fixing apparatus by making a fixing film generate heat by an induction heating system.

The present invention makes the set temperature when the leading-edge region of a recording material in its carrying direction is fixed lower than the set temperature when a region at the downstream side of the leading-edge region is fixed. It is necessary to lower a set temperature and the temperature of the fixing film 10 before the recording material enters the fixing nit part N.

Figure 11:
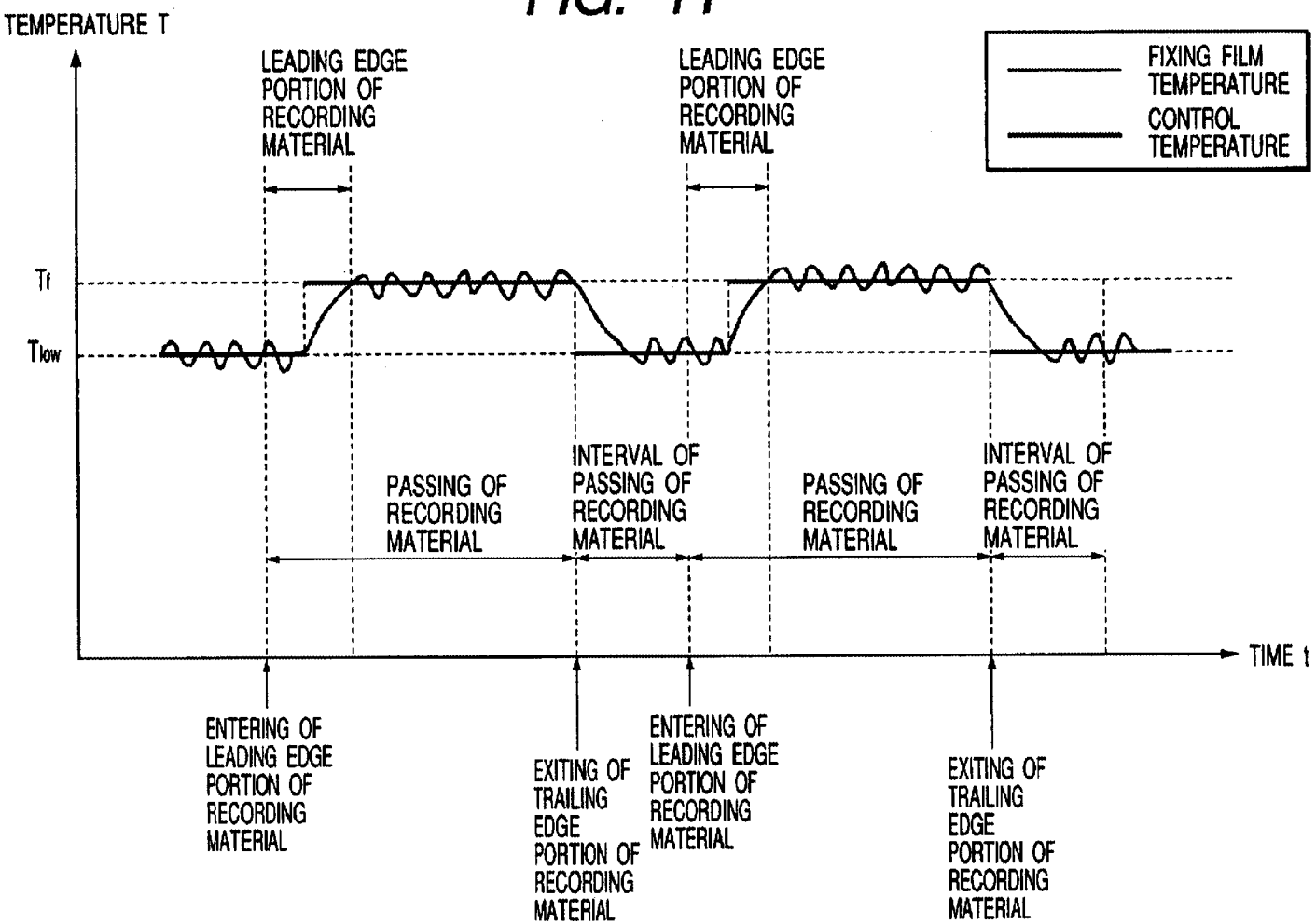
FIG. 11 is an illustration for explaining the temperature control by first embodiment of the present invention.

FIG. 11 is a schematic view showing temperature control in this embodiment. In FIG. 11, elapsed time is assigned to the axis of abscissa and temperature is assigned to the axis of ordinate. In FIG. 11, a thick line in FIG. 11 denotes a set temperature (control temperature) and a thin line denotes an actual temperature of a fixing film.

In the case of this embodiment, as shown in FIG. 11, the set temperature when the leading-edge region in the carrying direction of a recording material is fixed is assumed as Tlow and the set temperature when a region at the downstream side of the leading-edge region is fixed is assumed as Tf. The adhesion between a fixing film and toner is lowered by slightly lowering the actual temperature of a recording material when fixing the leading-edge region of the recording material so that the recording-material leading-edge region is easily removed from the fixing film. Therefore, Tlow is lower than Tf. It is preferable to prepare for fixing of a recording material by previously lowering a set temperature after raising a temperature at start of printing or between sheets while continuously supplying a recording material to the fixing nip portion N. Particularly, in the case of a fixing apparatus using a fixing sleeve having a large heat capacity, it is necessary to early change set temperature under fixing for the temperature of a fixing sleeve to follow a change of set temperatures. Moreover, the set temperature Tlow of the leading-edge region of a recording material in its carrying direction under fixing is lowered up to a temperature at which a twining jam or hot offset does not occur so that a fixing trouble is not caused by an insufficient heat capacity. In the case of this embodiment, Tf is set to 190° C. and Tlow is set to 175° C.

According to the study by the present inventor et al., it is found that a trouble such as twining of a recording material on a fixing film can be prevented because by heating the recording material at a temperature lower than Tf at least immediately before the leading edge of the recording material enters the nip portion of a discharge roller pair (carrying means) 60 (refer to FIG. 12), the leading edge of the discharge roller pair 60 is thereafter held. Therefore, it is clarified that it is proper to set the region of the recording material to be heated at a temperature lower than Tf to a length 0.9 to 2.6 times larger than the distance between the fixing nip portion and the nip portion of the discharge roller pair from the leading edge of the recording material.

As shown in FIG. 11, even if set temperatures (control temperatures) are changed, there is a slight time difference by the time when the temperature of a film reaches the set temperature after changed in fact. Therefore, it is necessary to change set temperatures as soon as possible by considering the time difference. To set the region to be heated at a temperature lower than the temperature Tf to a value 0.9 to 2.6 times larger than the distance between the fixing nip portion and the nip portion of the discharge roller pair from the leading edge of the recording material, it is proper to set the set-temperature change timing when the leading edge of the recording material passes through the fixing nip portion by the "length 0.3 to 2.0 times larger than the distance between the fixing nip portion and the nip portion of the discharge roller pair".

Thus, in the case of this embodiment, set temperatures are changed at a predetermined timing when the leading edge of a recording material passes through the fixing nip portion by the "length 0.3 to 2.0 times larger than the distance between the fixing nip portion and the nip portion of the discharge roller pair". The carrying behavior of the leading edge of the recording material in its carrying direction becomes unstable and a twining jam or hot offset easily occurs during the period until reaching the farthest carrying position of the recording material from the fixing nip portion N.

Figure 12:
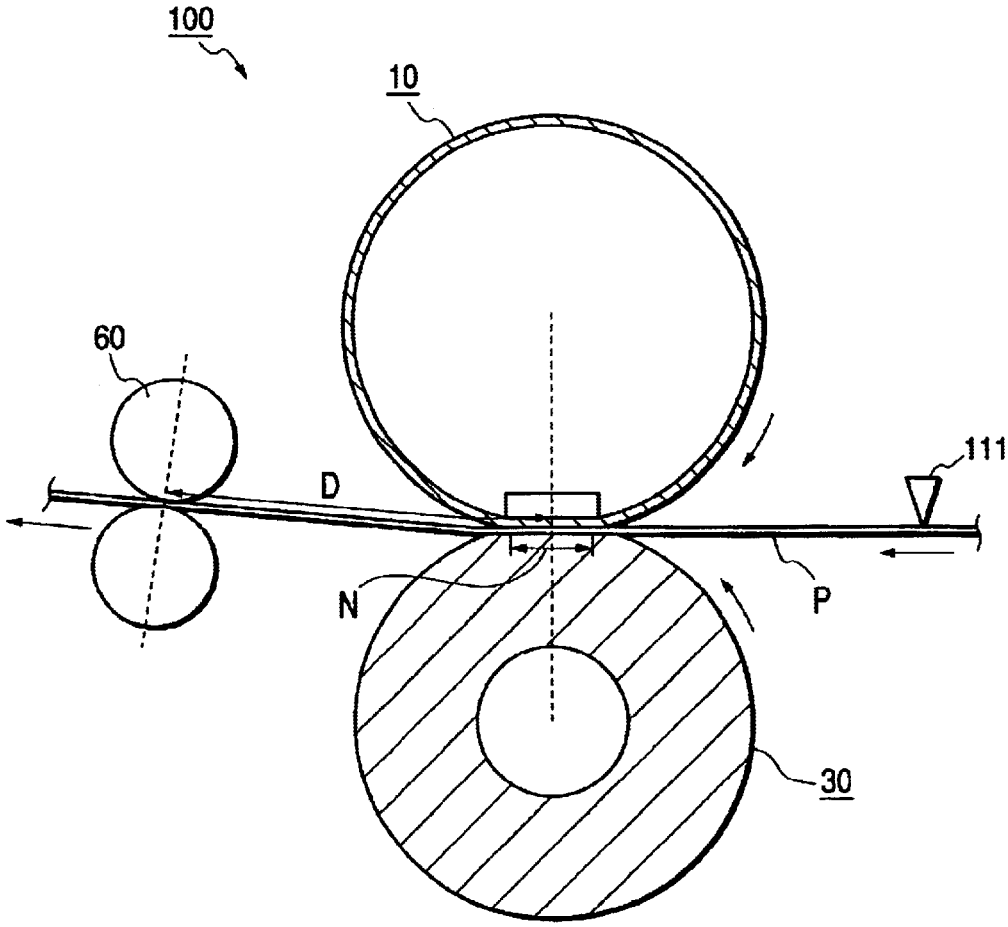
FIG. 12 is an illustration for explaining the relation between the nip region of the fixing apparatus and the recording-material carrying position of the carrying means of the first embodiment of the present invention.

FIG. 12 is a schematic sectional view showing the positional relation between the fixing nip portion N and the discharge roller 60 of this embodiment.

In the case of this embodiment, the discharge roller 60 is the first carrying means after a recording material passes through the fixing nip part N and the spatial distance between the fixing nip part N (center of nip portion) and the farthest recording-material-carrying position of the discharge roller 60 (center of nip portion of carrying means) is equal to D. Therefore, a region whose set temperature is equal to Tlow is formed in a range between 0.3×D and 2.0×D (both included) from the leading edge of a recording material in its carrying direction. When a region for lowering the set temperature of a recording material when fixed is smaller than a value 0.3 times larger than the above spatial distance D, the effect for preventing a twining jam or hot offset of a recording material cannot be sufficiently exhibited. However, when the region is larger than a value 2.0 times larger than the above spatial distance D, there is a problem that the glossiness or OHT permeability of the whole image is deteriorated. In the case of this embodiment, the spatial distance D between the fixing nip portion N and the farthest recording-material-carrying position of the discharge roller 60 is equal to 25 mm and the most-downstream position for lowering the set temperature when a recording material is fixed to Tlow (that is, position for changing set temperature from Tlow to Tf) is set to the length of 1.2×D (=30 mm) from the leading edge of the recording material. By changing set temperatures at this timing, regions at and after (1.8×D)=45.0 mm from the leading edge of the recording material are heated at the temperature Tf.

Therefore, as described above, according to this embodiment, it is possible to prevent an image trouble due to a twining jam or hot offset of a recording material in a fixing apparatus and thereby, it is possible to stabilize carrying and improve the image quality.

Figure 14:
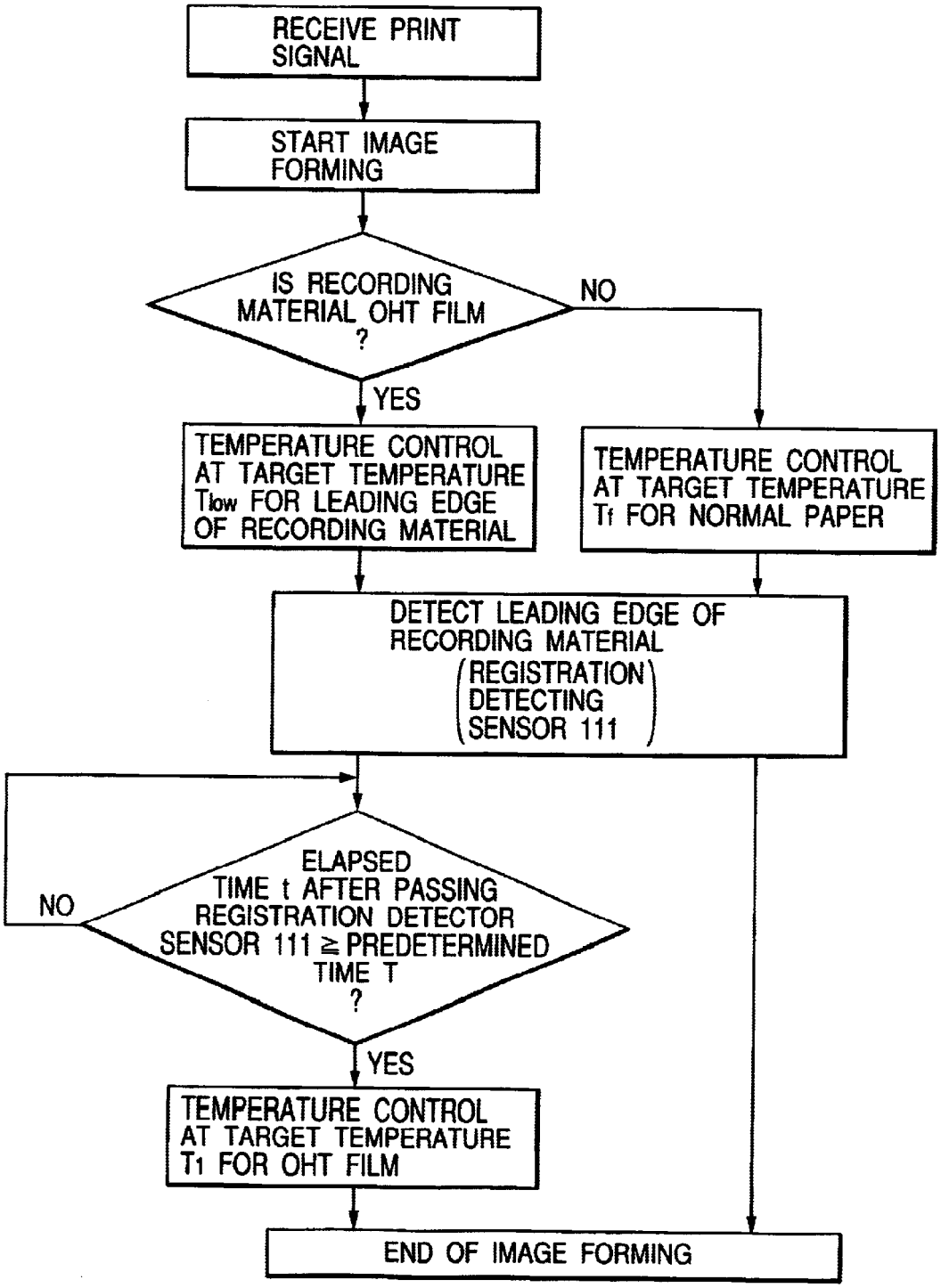
FIG. 14 is a flowchart showing a mode change according to the type of a recording material.

It is allowed to perform the control (mode) for heating regions from the leading edge of a recording material up to a predetermined distance at a low temperature such as the above temperature Tf only for a recording material whose behavior is unstable after passing through the fixing nip portion. For example, in the case of a resin sheet which becomes week-kneed when heated, it is allowed to execute the above set-temperature change mode. In the case of a recording material made of a material other than the above resin sheet or plain paper, it is proper to execute the normal mode for heating a recording material from its leading edge at the temperature Tf without changing set temperatures. FIG. 14 is a flowchart showing the above example of changing modes in accordance with the type of a recording material. In the case of the example in FIG. 14, the type of a recording material is determined depending on OHT or not. However, a criterion is not restricted to the above example. Moreover, it is allowed that the temperature Tf differ depending on OHT or plain.

(Second Embodiment)

Then, second embodiment of the present invention is described. A configuration same as that of the above first embodiment is provided with the same symbol and its description is omitted.

This embodiment has a feature of lowering a set temperature when the leading edge of a recording material in its carrying direction is fixed in accordance with the temperature of a pressure roller in addition to the temperature control in the first embodiment.

When performing intermittent printing or continuous printing, the pressure roller 30 receives heat from the fixing film 10 and thereby, the temperature of the pressure roller 30 rises. When the temperature of the pressure roller 30 rises, heat is added to a printing material from not only the fixing film 10 but also the pressure roller 30 and thus, the heat quantity added under fixing becomes excessive. Therefore, it is necessary to lower the set temperature of the leading-edge region of the recording material in its carrying direction when the leading-edge region is fixed and keep the heat quantity added to the recording material constant.

In the case of this embodiment, in order to determine a temperature state of a pressure roller, a thermistor (not illustrated) serving as temperature detecting means is provided for the pressure roller 30 to slowly lower the set temperature Tlow in the leading-edge region of a recording material in its carrying direction in accordance with the rise of a detected temperature of the temperature detecting means. Moreover, it is allowed to equally lower not only the set temperature Tlow of the leading-edge-side region of a recording material in its carrying direction but also the set temperature Tf while the whole recording material is fixed.

Therefore, as described above, according to this embodiment, it is possible to prevent an image trouble due to a twining jam or hot offset of a recording material in a fixing apparatus independently of the temperature-rise state of the pressure roller 30. Therefore, it is possible to further stabilize carrying and improve an image quality. Moreover, it is allowed to set the above set-temperature change mode only when a predetermined recording material is used the same as the case of the first embodiment.

(Third Embodiment)

Then, third embodiment of the present invention is described below. A configuration same as that of the above first embodiment or second embodiment is provided with the same symbol and its description is omitted.

This embodiment has a feature of confirming the temperature-rise state of the pressure roller 30 without using a thermistor for detecting the temperature of the pressure roller 30 under the temperature control in the above second embodiment. Thereby, it is possible to cut the cost of an image forming apparatus.

In the case of this embodiment, the temperature-rise state of the pressure roller 30 is confirmed in accordance with two parameters such as a parameter for a temperature fall value of the fixing film 10 when not heated and a parameter for the number of recording-material sheets to be continuously supplied to the fixing nip portion N under continuous image formation of a plurality of recording materials.

Figure 13:
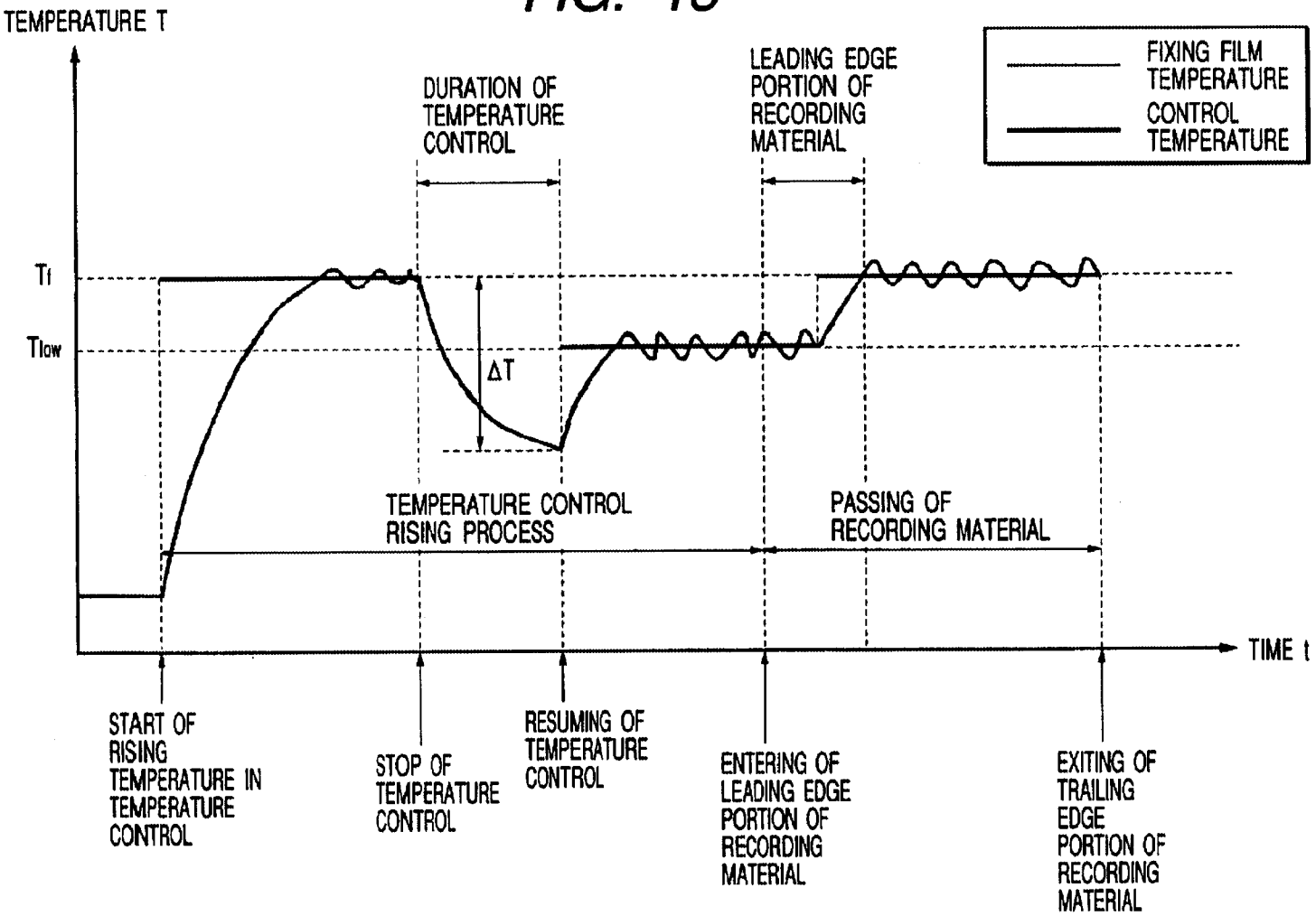
FIG. 13 is an illustration for explaining the temperature control by third embodiment of the present invention.

FIG. 13 is a schematic view showing the temperature control in this embodiment. In FIG. 13, elapsed time is assigned to the axis of abscissa and temperature is assigned to the axis of ordinate. In FIG. 13, a thick line denotes a set temperature (control temperature) and a thin line denotes a fixing-film temperature.

First, the temperature control is described which confirms the temperature-rise state of the pressure roller 30 in accordance with the temperature fall value of the fixing film 10 when not heated.

In the step of raising temperature control at start of printing, the temperature of the fixing film 10 is raised up to a predetermined value. Though the predetermined temperature is assumed as Tf in the above case, it is not restricted to Tf.

Then, supply of power to a fixing apparatus is stopped to stop temperature control for a certain period. Then, the temperature fall value $\Delta T$ of the fixing film 10 for unit time is measured. When the pressure roller 30 is cooled, the heat of the fixing film 10 is easily taken by the pressure roller 30. Therefore, the temperature fall value $\Delta T$ of the fixing film 10 for a certain period increases. However, when the temperature of the pressure roller 30 rises (temperature is accumulated), the temperature fall value $\Delta T$ decreases. Therefore, it is possible to confirm the temperature rise state of the pressure roller 30 in accordance with the temperature fall value large $\Delta T$ of the fixing film 10 for unit time. As the temperature fall value $\Delta T$ of the fixing film 10 decreases, it is proper to lower the set temperature Tlow of a recording material in its carrying direction when the leading-edge region of the recording material is fixed. It is also allowed to equally lower set temperatures (both Tlow and Tf) when the whole recording material is fixed.

After determining a temperature state of the pressure roller, supply of power to the fixing apparatus is restarted to resume temperature control. In this case, a set temperature is set in accordance with the previously-determined temperature fall value $\Delta T$ of the fixing film 10.

Then, the temperature control for confirming the temperature rise state of the pressure roller 30 in accordance with the number of continuous feed sheets is described.

By performing continuous printing, it is a matter of course that the temperature of the pressure roller 30 rises because the pressure roller 30 receives heat from the fixing film 10. Therefore, it is proper to lower the set temperature Tlow when the leading-edge region of the recording material in its carrying direction is fixed in accordance with the number of continuous feed sheets. It is also allowed to lower not only the set temperatures Tlow but also the set temperature Tf when the whole recording material is fixed.

When the period between sheets is comparatively long (when the number of sheets to be processed for unit time is small), it is also allowed to detect the temperature of the pressure roller 30 in accordance with the temperature fall value of the fixing film 10 when not heated between sheets as described above.

Therefore, as described above, this embodiment makes it possible to prevent an image trouble due to a twining jam or hot offset of a recording material in a fixing apparatus independently of the temperature rise state of the pressure roller 30 and further stabilize carrying and improve the image quality at a low cost.

Though the first embodiment to the third embodiment respectively use a magnetic-induction-type film heating system, a fixing apparatus of the present invention is not restricted to the above fixing apparatus. It is also allowed to use a ceramic-heater-type film heating apparatus as heat generating means. Moreover, it is allowed to use a heat-roller-type apparatus.

Moreover, a principle and process for forming an unfixed toner image on a recording material of an image forming apparatus are not restricted but they are optional. It is allowed to use a transfer method for forming an image on a carrying body such as a photosensitive member and then transferring the image to a recording material or a direct method for directly forming an image on a recording material.

The present invention is not restricted to the above cases but it includes modifications within the technical thought.

What is claimed is:

1. An image heating apparatus for heating an image formed on a recording material, comprising:

heating means including a nip portion for holding and conveying the recording material;

conveying means provided just after the nip portion in the recording-material moving direction; and control means for controlling an electric power supply to the heating means so that a temperature of the heating means is maintained at a set temperature, wherein the control means has a mode for changing the set temperature from a first temperature to a second temperature higher than the first temperature when the leading edge of the recording material passes through the nip portion by a predetermined distance and the predetermined distance is equal to a value 0.3 to 2.0 times larger than a distance between the nip portion and the conveying means.

2. An image heating apparatus according to claim 1, wherein the heating means has a heating member and a backup member for forming the nip portion together with the heating member and the control means sets the first temperature in accordance with a temperature state of the backup member.

3. An image heating apparatus according to claim 2, wherein the control means sets the first temperature to a smaller value as a temperature of the backup member rises.

4. An image heating apparatus according to claim 2, wherein the apparatus further includes a temperature detecting member for detecting the temperature of the backup member and the control means sets the first temperature in accordance with the output of the temperature detecting member.

5. An image heating apparatus according to claim 2, wherein a temperature state of the backup member changes in accordance with a carrying condition of the recording material and the control means sets the first temperature in accordance with the carrying condition of the recording material.

6. An image heating apparatus according to claim 1, wherein the control means further sets the mode in accordance with a type of the recording material.

7. An image heating apparatus according to claim 1, wherein the heating means effects the heating with induction heating.

8. An image heating apparatus for heating an image formed on a recording material, comprising:

heating means including a nip portion for holding and conveying the recording material; and conveying means provided just after the heating means in the recording-material moving direction, wherein the apparatus has a mode for heating the range from the leading edge of the recording material up to a predetermined distance at a temperature lower than the subsequent temperature by the heating means and the predetermined distance is equal to a value 0.9 to 2.6 times larger than a distance between the nip portion and the conveying means.

9. An image heating apparatus according to claim 8, wherein the heating means effects the heating with induction heating.

10. An image heating apparatus for heating an image formed on a recording material, comprising:

heating means having a nip portion for holding and conveying the recording material;

conveying means provided just after the heating means in the recording-material moving direction;

control means for controlling an electric power supply to the heating means so that a temperature of the heating means is maintained at a set temperature, wherein the control means has a mode for changing the set temperature from a first temperature to a second temperature higher than the first temperature after the leading edge of the recording material passes through the nip portion and sets the mode in accordance with a type of the recording material.

11. An image heating apparatus according to claim 10, wherein the control means sets the mode when the recording material is a resin sheet.

12. An image heating apparatus according to claim 11, wherein the control means does not change the set temperature while one sheet of the recording material passes through the nip portion when the recording material is paper.

13. An image heating apparatus according to claim 10, wherein the control means changes the set temperature to the second temperature when the leading edge of the recording material passes through the nip portion by a predetermined distance and the predetermined distance is equal to a value 0.3 to 2.0 times larger than a distance between the nip portion and the conveying means.

14. An image heating apparatus for heating an image formed on a recording material, comprising:

heating means having a nip portion for holding and conveying the recording material, the heating means including a heating member and a backup member for forming the nip portion together with the heating member;

conveying means provided just after the nip portion in the recording-material moving direction;

control means for controlling an electric power supply to the heating means so that a temperature of the heating means is maintained at a set temperature, wherein the control means has a mode for changing the set temperature from a first temperature to a second temperature higher than the first temperature after the leading edge of the recording material passes through the nip portion and sets the first temperature in accordance with a temperature state of the backup member.

15. An image heating apparatus according to claim 14, wherein the control means sets the first temperature to a smaller value as a temperature of the backup member rises.

16. An image heating material according to claim 14, wherein the control means further sets the second temperature in accordance with a temperature state of the backup member.

17. An image heating apparatus according to claim 16, wherein the control means sets the first and second temperatures to smaller values as a temperature of the backup member rises.

18. An image heating apparatus according to claim 14, wherein the control means further sets the mode in accordance with a type of the recording material.

19. An image heating apparatus according to claim 14, wherein the control means changes the set temperature to the second temperature when the leading edge of the recording material passes through the nip portion by a predetermined distance and the predetermined distance is equal to a value 0.3 to 2.0 times larger than a distance between the nip portion and the conveying means.

* * * * *

UNITED STATES PATENT AND TRADEMARK OFFICE

CERTIFICATE OF CORRECTION

PATENT NO. : 6,847,793 B2
DATED : January 25, 2005
INVENTOR(S) : Masahiro Suzuki et al.

It is certified that error appears in the above-identified patent and that said Letters Patent is hereby corrected as shown below:

Column 1,
Line 40, “weak kneed” should read -- weak-kneed --; and
Line 58, “twins” should read -- twines --.

Column 3,
Line 4, “the.” should read -- the --; and
Line 24, “)another” should read -- another --.

Column 4,
Line 31, “104B” should read -- 104Bk --;
Line 32, “an” should read -- a --; and
Line 66, “discharged an” should read -- discharged to an --.

Column 7,
Line 14, “above-right” should read -- above right --; and
Line 33, “welded” should read -- welded to --.

Column 9,
Line 6, “in stead” should read -- instead --.

Column 10,
Line 27, “almost” should read -- almost all the --.

Column 12,
Line 11, “possible” should read -- possible to --; and
Line 46, “nit” should read -- nip --.

Column 13,
Line 6, “lowered up” should read -- lowered --;
Line 8, “trouble” should read -- problem --; and
Line 12, “trouble” should read -- problem --.

Column 14,
Line 13, “trouble” should read -- problem --.

Column 15,
Line 2, “trouble” should read -- problem --; and
Line 8, “as” should read -- as in --.

UNITED STATES PATENT AND TRADEMARK OFFICE

CERTIFICATE OF CORRECTION

PATENT NO. : 6,847,793 B2
DATED : January 25, 2005
INVENTOR(S) : Masahiro Suzuki et al.

It is certified that error appears in the above-identified patent and that said Letters Patent is hereby corrected as shown below:

Column 16,
Line 16, “trouble” should read -- problem --.

Signed and Sealed this

Thirty-first Day of May, 2005

JON W. DUDAS
*Director of the United States Patent and Trademark Office*